United States Patent [19]

Kottke et al.

[11] 4,175,067

[45] Nov. 20, 1979

[54] CURABLE BINDER FOR LARGE FOUNDRY SAND SHAPES

[75] Inventors: Roger H. Kottke, Crystal Lake; Scott S. Menard, Mt. Prospect, both of Ill.

[73] Assignee: The Quaker Oats Company, Chicago, Ill.

[21] Appl. No.: 825,447

[22] Filed: Aug. 17, 1977

[51] Int. Cl.[2] ..... C08K 5/05; C08K 3/36; C08K 5/10

[52] U.S. Cl. ..... 260/30.4 R; 164/43; 260/29.15 B; 260/29.4 R; 260/30.4 N; 260/30.4 SB; 260/31.8 J; 260/33.2 R; 260/33.2 SB; 260/33.4 R; 260/395 B; 260/42.53; 260/31.8 S; 525/418

[58] Field of Search ..... 260/829, 67 F, 67 FA, 260/39 SB, DIG. 40, 42.53, 33.2 R, 33.2 SB, 31.8 S, 31.8 T, 30.4 R, 30.4 SB, 826; 164/43; 526/11.1

[56] References Cited

U.S. PATENT DOCUMENTS

| | | | |
|---|---|---|---|
| 2,471,600 | 5/1949 | Adams et al. | 260/67 FA |
| 3,024,215 | 3/1962 | Freeman et al. | 260/42.53 |
| 3,057,026 | 10/1962 | Blaies et al. | 260/829 |
| 3,184,814 | 5/1965 | Brown | 260/67 FA |
| 3,247,556 | 4/1966 | Buell et al. | 260/829 |
| 3,716,512 | 2/1973 | Vargiv et al. | 260/39 SB |
| 3,734,936 | 5/1973 | Brown et al. | 260/39 SB |
| 3,793,286 | 2/1974 | Petersen et al. | 260/39 SB |
| 4,033,925 | 7/1977 | Anderson | 260/DIG. 40 |

*Primary Examiner*—Herbert J. Lilling
*Attorney, Agent, or Firm*—Joseph P. O'Halloran

[57] ABSTRACT

A furfuryl alcohol-based foundry binder for use in the manufacture of large foundry sand shapes is disclosed. It is intended as a replacement for conventional alkyd oil foundry binders, and comprises a monomeric mixture of furfuryl alcohol, other alcohols, glycols, or polyols, and high boiling mixtures of ester-substituted diphenyl and polyphenyl aromatic compounds, and a strong acid catalyst. In addition, the binder may include, for example, urea-formaldehyde syrup.

11 Claims, No Drawings

CURABLE BINDER FOR LARGE FOUNDRY SAND SHAPES

BACKGROUND OF THE INVENTION

This invention relates to a binder for use in the manufacture of very large sand shapes for the manufacture of large castings. Typically, so-called alkyd oil binders have been used in this application, because such binders provide relatively slow cure, as well as flexibility sufficient to facilitate separation of the sand shapes from the patterns from which, or in which, they are made. Furfuryl alcohol resins, on the other hand, have provided the basis of a large variety of highly successful foundry binders, and yet have not been used in any substantial amount in connection with the manufacture of extremely large sand shapes such as, for example, those used in the fabrication of slag pots for blast furnaces, and the like. The furfuryl alcohol resins have enjoyed widespread use, in part, because of the relatively rapid rate of cure which is achieved at room temperature using a relatively low amount of strong acid catalyst. However, in the manufacture of extremely large foundry sand shapes, the relatively rapid cure rate which is associated with furfuryl alcohol-based or furfuryl alcohol resin-based binders commonly would ordinarily lead to premature setting, or hardening of the sand mix and, in general, provides working lives too short to be practical. On the other hand, when catalyst levels are reduced sufficiently when using furfuryl alcohol-derived binders, to provide a working life of sufficient duration to accommodate the manufacture of the very large sand shapes, the rate of cure of the furfuryl alcohol binder is generally too slow to provide for a complete cure within the time-frame requirement imposed at the foundry and, in fact, it is insufficient catalyst for complete cure over any length of time.

On the other hand, the alkyd resin-based binders, though providing a slower cure rate, do suffer from several disadvantages. For example, the so-called "alkyd oil" binders are, in fact, mixtures of high hydroxyl alkyd resins, or a chemically modified highly unsaturated oil such as, for example, linseed oil, with polyisocyanate, and metal-ion catalysts such as cobalt naphthenate, stannous octoate, stannous naphthenate, and cobalt octoate. The hydroxyl moieties are derived from reaction of polyhydric alcohols, such as pentaerythritol and sorbitol with the oils. See U.S. Pat. Nos. 3,426,831 and 3,225,500 and British Pat. No. 1,073,843 for a discussion of the preparation of these binders. These complex mixtures do undergo some curing at room temperature. However, in order to achieve complete cure, heating is typically required. Even at room temperature, however, the alkyd binder-coated sands have a pronounced paint odor, and this odor becomes even more odious upon heating of the sand shapes during the curing process. This binder gives a greater preponderance of casting defects than the furfuryl alcohol binders. Mechanical methods of sand reclamation are not as effective on the alkyd oils as on the sand shapes made from furfuryl alcohol binders.

We have discovered that, in accordance with the present invention, a furfuryl alcohol-based resin, can be utilized in the fabrication of extremely large castings, using a binder which has all of the advantages of the so-called "alkyl oil" binder systems, with none of their disadvantages. Thus the furfuryl alcohol binders of this invention provide a slow rate of cure to permit time to fabricate along with high cured strength. Also they provide flexibility at strip to allow easy release from poor quality patterns. Furthermore, in accordance with the present invention, it has been observed that the furfuryl alcohol-based alkyd resin replacement binder provides a lower smoke evolution during pour, better reclamation of sand, and does not require baking for a complete and useful cure.

SUMMARY OF THE INVENTION

In accordance with the present invention, the alkyd oil binder replacement is provided by admixing monomeric furfuryl alcohol in an amount between 45–85 percent based on the weight of the binder, about 65 percent being preferred, with ester-substituted phenyl compounds, including diphenyl and polyphenyl aromatic compounds in an amount between 5–50 percent based on the weight of the binder, with another alcohol, in an amount between 2–15 percent by weight based on the weight of the binder. The binder is cured with a strong acid catalyst having a pKa lower than 2.3, in an amount between 10–75 typically, based on the weight of the binder, but more preferably in the range of 20–60 percent by weight based on the weight of the binder.

Optionally, a urea-formaldehyde ingredient, such as, for example, a urea-formaldehyde syrup, or a urea-formaldehyde concentrate, can be used in an amount from 0–30 percent by weight based on the weight of the binders. The urea-formaldehyde syrups typically have a higher nitrogen and a lower formaldehyde level than urea-formaldehyde concentrates, and, generally speaking, are preferred over the urea-formaldehyde concentrates.

Generally speaking, the physical attributes of the binder and the cured sand shapes made therefrom, in accordance with the present invention, are not particularly sensitive to relatively large variations in the furfuryl alcohol level in the binder. However, generally speaking, the higher levels of furfuryl alcohol, e.g. 80 percent and above, provide binders which exhibit slightly shorter working time than the binders in accordance with the present invention which utilize relatively low levels of furfuryl alcohol such as, for example, 45 percent.

The diphenyl and polyphenyl aromatic compounds which are preferred for use with the present invention are carboxmethoxy polyphenyl, and polycarbomethoxy diphenyls and these are preferably used in admixture with benzyl esters of the toluate family. A commercially available ingredient which provides these components in accordance with the present invention are any of the products known by the name Terate (T.M. Hercules, Incorporated), especially, for example, Terate 131. These materials are reported to be petroleum aromatic hydrocarbons produced in the production of dimethyl terephthalate. Similar compositions are also available as Terate 303, Terate 101, Terate 121, and the like.

The commercially available ingredient known as Terate 101 is reported to contain approximately 30 percent of polycarbomethoxyl diphenyls, and 35 percent carbomethoxy polyphenyls, thus providing approximately 60 percent carbomethoxyl or polycarbomethoxyl diphenyls or polyphenyls. The Terate 121 is reported to contain approximately 20 percent polycarbomethoxyl diphenyls, and 40 percent carbomethoxy polyphenyls, whereas the material known as Terate 131 is reported to contain approximately 10 percent polycarbomethoxyl diphenyls, and 45 percent carbomethoxy polyphenyls, the latter also providing approximately 60 percent carbomethoxy di- and polyphenyls.

With respect to the "other" alcohol ingredient, this would include monohydric, dihydric or polyhydric alcohols, including, for example, ethylene glycol, diethylene glycol, isooctyl alcohol, isobutyl alcohol, tetrahydrofurfuryl alcohol, propylene glycol, glycerol, isopropyl alcohol, 1-propanol, butanediols, pinacol and the like.

It is well recognized in the foundry practice to include silanes with binders in the fabrication of foundry sand shapes, and we have found that any of the silane adhesion modifiers which are widely used in the art are compatible with the binder and method of the present invention. Typically, the silanes are added, in accordance with the present invention, in an amount of about 0.15–0.30 percent based on the weight of the binder.

Catalysts which are useful in accordance with the method of the present invention include those strong acid catalysts having a pKa less than 2.3. Such acid catalysts include, for example, phosphoric acid, any aromatic sulfonic acid such as, for example, toluene sulfonic acid, benzene sulfonic acid, cumene sulfonic and cresol sulfonic acids. Xylene sulfonic is also useful in accordance with the present invention. The particular catalyst employed has some effect on the working life of the resin in accordance with the present invention, so that, for example, using identical formulations in each instance, benzene sulfonic acid gives a working life of 17 minutes, whereas phosphoric acid gives a working life of approximately 60 minutes. This will be further illustrated in the examples which follow.

The binder of the present invention is used in the conventional concentrations on the sand mix, e.g. from 0.5 to 3.0 percent. The preferred range is from 1.0 to 1.5 percent.

The invention will be further illustrated with the aid of the following examples in which all temperatures are expressed in degrees centigrade, and all "parts" are expressed in parts by weight, and all percentages are expressed in percent by weight based on the weight of the composition then referred to.

EXAMPLE 1

The purpose of this example is to illustrate a method for preparing a binder in accordance with the present invention. A mix is prepared comprising: 65 parts furfuryl alcohol, 7 parts ethylene glycol, 21 parts Terate 131 (T.M. Hercules, Incorporated), (to provide 2.1 parts polycarbomethoxyl diphenyls, 0.84 parts of benzyl esters of the toluate family, and 9.5 parts carbomethoxy polyphenyls), and 7 parts Areotex 581 urea-formaldehyde syrup (T.M. American Cyanamid containing 1.5–2.0 percent free formaldehyde, a pH of 8–9 and a viscosity range of 800–1200 cps. at 25° C.). The admixture is warmed to a temperature of 35° C. to facilitate the mixing. The mixing continues until a homogenous solution is achieved. The mixture is then allowed to cool to room temperature and a commercially available substituted silane, A1160 Ureido-silane (T.M. Union Carbide Chemicals & Plastics) (0.3 parts) is added and the mixing continued for approximately 10 minutes. The resulting mixture constitutes a binder for use in accordance with the present invention.

EXAMPLE 2

This example illustrates the use of a binder in accordance with the present invention in the preparation of an acid hardened sand mix.

Wedron 5025 foundry sand, AFS grain fineness No. 57, (3000 parts) and toluene sulfonic acid (65 percent solution in water, 9.4 parts) are admixed by mulling for two minutes to achieve a uniform distribution of the acid on the admixture. A 37.5 part portion of the liquid binder prepared in accordance with Example 1 is then added to the sand mix and mulled for two minutes.

As soon as the binder is uniformly distributed on the acid catalyzed sand mix, the catalyzed binder coated sand mix is subjected to a bench life determination while, simultaneously, tensile strength specimen biscuits (1" cross sectional area) are prepared. The bench life is determined by the use of a Dietert sand rammer. The bench life is generally accepted to be determined as the time in which the number of rams required to compress a loosely filled predetermined volume to a preset volume is double the number of rams initially required to reach the preset volume.

The ambient room temperature is 24° C. and the sand temperature when mixed is 22° C. The sand binder mixture has a bench life of 70 minutes.

Tensile strengths are tested after storage for 8½ hours at the stated relative humidities as set forth in Table I, after overnight initial cure at ambient temperature and relative humidity. The tensile strength numbers set forth in Table I represent an average of 6 determinations, in each instance.

TABLE I

| Relative Humidity | Tensile Strength (psi)/ Scratch Hardness |
|---|---|
| 37% | 380/65 |
| 90% | 265/63 |

EXAMPLE 3

The purpose of this example is to illustrate the preparation of an acid hardened sand-binder mix, in accordance with the present invention, with and without the addition of a silane.

Two batches of foundry sand mix were prepared as follows: foundry sand (3000 parts), and toluene sulfonic acid (65 percent solution in water, 11.25 parts) were admixed by mulling to achieve a uniform distribution of the acid on the admixture.

A binder, in accordance with the present invention, is prepared by admixing 60 parts furfuryl alcohol, 10 parts ethylene glycol, 15 parts Areotex 581 urea-formaldehyde syrup, and 15 parts Terate 203 (T.M. Hercules, Incorporated. Terate 203 is the transesterification product of diethylene glycol and Terate 101 (T.M. Hercules, Incorporated). Terate 101 is a mixture comprising: 30 parts polycarbomethoxyl diphenyl, 25 parts benzyl esters of the toluate family, and 35 parts carbomethoxyl polyphenyls.) A portion of this liquid binder is then separated into two respective 37.5 part by weight aliquots. Into one of the aliquots, 0.3 parts of A1160 Ureido-silane (T.M. Union Carbide Chemicals & Plastics) (50 percent in methanol) is added. No silane is added to the other aliquot. Each respective aliquot of binder is added to a respective sand mix and the respective admixtures are mulled separately. As soon as the resins are uniformly distributed on the acid catalyzed sand mixes, the respective catalyzed binder coated mixes are subjected to bench life determination and tensile strength tests by the methods described in Example 2.

The tensile tests are run after overnight storage at the ambient relative humidity, then half of the samples are subjected to high relative humidity (94%). The tensile strength numbers set forth in Table II represent an average of six determinations, in each instance.

TABLE II

| | Bench Life (Min.) | Tensile Strength (psi)/Scratch Hardness 30% R.H. | 94% R.H. |
|---|---|---|---|
| With Silane | 40 | 410/38 | 170/83 |
| Without Silane | 55 | 160/74 | 33/88 |

EXAMPLE 4

The purpose of this example is to illustrate the use of various alcohols as modifiers in the binders of the present invention.

The binder in each test is prepared by admixing, according to the procedure of Example 3, 60 parts of furfuryl alcohol, 15 parts of Areotex 581 urea-formaldehyde syrup (T.M. American Cyanamid), 15 parts of Terate 203 (T.M. Hercules, Incorporated. Terate 203 is the transesterification product of diethylene glycol and Terate 101 (T.M. Hercules, Incorporated). Terate 101 is a mixture comprising 30 parts polycarbomethoxyl diphenyls, 25 parts benzyl esters of the toluate family, and 35 parts carbomethoxy polyphenyls), and 10 parts of an alcohol—tetrahydrofurfuryl alcohol, isooctyl alcohol, or isobutyl alcohol in Tests 4-1, 4-2, 4-3, respectively. Then, a 0.3 part aliquot of A1160 Ureido-silane (50 percent in methanol) (T.M. Union Carbide Chemicals & Plastics) is admixed with each respective binder mixture.

The sand-catalyst mix employed in Test 4-1 is prepared by mulling 3000 parts Wedron 5025 silica sand and 9.4 parts toluene sulfonic acid (65 percent solution in water). The mulling continues until a uniform distribution of the acid on the admixture is achieved.

The sand-catalyst mix employed in Test 4-2 is prepared by admixing by mulling 3000 parts of Wedron 5025 silica sand and 10.5 parts phosphoric acid (85 percent solution in water). The mulling is continued until a uniform distribution of the acid on the admixture is achieved.

The sand-catalyst mix employed in Test 4-3 is prepared by admixing by mulling 3000 parts of Wedron 5025 silica sand and 10.5 parts toluene sulfonic acid (65 percent solution in water). The mulling is continued until a uniform distribution of the acid on the admixture is achieved.

Then, a 37.5 part aliquot of the binder is added to each respective sand-catalyst mix and the respective admixtures are mulled separately. As soon as the binder is uniformly distributed on the acid catalyzed sand mix the respective catalyzed binder coated mixes are subjected to bench life determination and, after curing, to tensile strength testing. The tensile strengths and bench lives are determined by the method described in Example 2.

The tensile strength tests are run as described in Example 3. The resulting tensile strength numbers, set forth in Table III, represent an average of six determinations, in each instance.

EXAMPLE 5

The purpose of this example is to provide a comparison of a few of the various acid catalysts which are effective for catalyzing the binders of the present invention.

The binder in each test is prepared by the procedure described in Example 1.

The sand-catalyst mix for each test in this example was prepared by admixing 3000 parts of Wedron 5025 silica sand and 11.25 parts of an acid catalyst. The acid catalyst employed in Test 5-1 is phosphoric acid (85 percent solution in water). In Test 5-2 the catalyst employed is toluene sulfonic acid (65 percent solution in water), and in Test 5-3 benzene sulfonic acid (75 percent solution in water) is employed. The respective sand mixes are mulled separately, with the mulling continuing until a uniform distribution of the acid on the admixtures is achieved.

Then, a 37.5 part aliquot of the binder is added to each respective sand-catalyst mix and the respective admixtures are mulled separately. As soon as the binder is uniformly distributed on each respective acid catalyzed sand mix, the respective catalyzed binder coated mixes are subjected to bench life determination and, after curing, to tensile strength testing. The tensile strengths and bench lives are determined by the method described in Example 2, and the results are tabulated in Table IV.

TABLE III

| Test | Alcohol (10 Parts) | Bench Life (Min.) | Tensile Strength (psi)/Scratch Hardness 30% R.H. | 90% R.H. |
|---|---|---|---|---|
| 4-1 | Tetrahydro-furfuryl Alcohol | 115 | 370/90 | 140/79 |
| 4-2 | Isooctyl Alcohol | 45 | 410/86 | 295/81 |
| 4-3 | Isobutyl Alcohol | 70 | 475/70 | 345/53 |

TABLE IV

| Test | Catalyst | Bench Life (Min.) | Tensile Strength (psi)/Scratch Hardness 63% R.H. | 95% R.H. |
|---|---|---|---|---|
| 5-1 | 85% $H_3PO_4$ | 60 | 285/54 | 210/47 |
| 5-2 | 65% Toluene Sulfonic Acid | 50 | 345/64 | 210/65 |
| 5-3 | 75% Benzene Sulfonic Acid | 17 | 345/65 | 275/62 |

EXAMPLE 6

The purpose of this example is to illustrate the effect of varying the amount of the ester substituted diphenyl and polyphenyl components, in the binders of the present invention.

In Test 6-1 a binder is prepared by admixing, according to the method of Example 1, 65 parts furfuryl alcohol, 7 parts of ethylene glycol, 7 parts of Areotex 581 urea-formaldehyde syrup, and 21 parts of Terate 131 used to provide 2.15 parts of polycarbomethoxyl diphenyls, 0.86 parts benzyl esters of the toluate family, and 9.68 parts of carbomethoxy polyphenyls. The binder of Test 6-2 is prepared by admixing 65 parts furfuryl alcohol, 7 parts of ethylene glycol, 7 parts of Areotex 581 urea-formaldehyde syrup, and 21 parts of Terate 203 (T.M. Hercules, Incorporated—referred to in Example 3). The binder of Test 6-3 was prepared by admixing 65 parts furfuryl alcohol, 7 parts of ethylene glycol, 7 parts of Areotex 581 urea-formaldehyde syrup, and 21 parts of Terate 303 (T.M. Hercules, Incorporated. Terate 303 is a transesterification product of ethylene glycol and Terate 131. Terate 131 is a mixture comprising 10 parts polycarbomethoxyl diphenyl, 4 parts benzyl esters of the toluate family and 45 parts carbomethoxy polyphenyl.) Then 0.3 parts A1160 Ureido-silane (T.M. Union Carbide Chemicals & Plastics) is added to each respective binder mixture.

The sand-catalyst mix for each test is prepared by the method described in Example 2.

A 37.5 part aliquot of each of the resin binders is added to a respective sand-catalyst mix and mulled separately. As soon as the binder is uniformly distributed on the acid catalyzed sand mix, the respective catalyzed binder coated mixes are subjected to bench life determinations and, after curing, the tensile strength tests are run, according to the methods set forth in Example 2. The tensile strength numbers set forth in Table V represent an average of six determinations, in each instance.

TABLE V

| Test | Terate | Bench Life (Min.) | Tensile Strength (psi)/Scratch Hardness 50% R.H. | 95% R.H. |
|---|---|---|---|---|
| 6-1 | 131 | 90 | 400/58 | 285/58 |
| 6-2 | 203 | 125 | 425/68 | 255/59 |
| 6-3 | 303 | 75 | 385/65 | 275/49 |

EXAMPLE 7

The purpose of this example is to provide a comparison of binders in accordance with the present invention which contain various levels of ethylene glycol.

The binders are prepared by admixing, in accordance with the method described in Example 1, the components in the amounts listed in Table VI. To each test binder is added 0.3 parts of A1160 Ureido-silane (T.M. Union Carbide Chemicals & Plastics) (50 percent in methanol).

The foundry sand-catalyst admixture is prepared by the method described in Example 2, and the binder is present on the sand in an amount 1.25 parts binder (based on the sand). The tensile strength specimen biscuits are prepared and tested in accordance with the method set forth in Example 2.

The bench life tests are run according to the method set forth in Example 2. The tensile strength numbers set forth in Table VI, represent an average of six determinations, in each instance.

TABLE VI

| Furfuryl Alcohol (parts) | Identity[2] of Terate | Terate Level (parts) | Urea-Formal-[1] dehyde Syrup (parts) | Ethylene Glycol Level (parts) | Bench Life (Min.) | Tensile Strength (psi)/Scratch Hardness 68% R.H. | 95% R.H. |
|---|---|---|---|---|---|---|---|
| [3]65 | 203 | 25 | 10 | 0 | 65 | 285/54 | 215/45 |
| 65 | 203 | 22.5 | 10 | 2.5 | 95 | 275/48 | 185/48 |
| 65 | 203 | 20 | 10 | 5 | 108 | 250/48 | 185/44 |
| 65 | 203 | 17.5 | 10 | 7.5 | 120 | 160/47 | 135/42 |
| 65 | 203 | 15 | 10 | 10 | 145 | 170/53 | 165/42 |
| 65 | 131 | 23 | 7 | 5 | 65 | 375/60 | 270/56 |
| 65 | 131 | 24.5 | 7 | 7.5 | 78 | 330/65 | 235/55 |
| 65 | 131 | 18 | 7 | 10 | 90 | 240/74 | 230/40 |

[1]Areotex 581 urea-formaldehyde syrup (T.M. American Cyanamid).
[2]Terate 203 (T.M. Hercules, Incorporated) is a transester of diethylene glycol and Terate 101 (T.M. Hercules, Incorporated). Terate 101 comprises: 30 parts polycarbomethoxyl diphenyls, 25 parts benzyl esters of toluate family, and 35 parts carbomethoxy polyphenyls. Terate 131 (T.M. Hercules, Incorporated) comprises: 10 parts polycarbomethoxyl diphenyls, 4 parts benzyl esters of toluate family and 45 parts carbomethoxy polyphenyls.
[3]Not in accordance with the present invention. Sand shapes produced have no plasticity, and therefore are unsuitable for use.

EXAMPLE 8

The effect of varying the level of binder employed in the sand mix is illustrated in this example.

The binder is prepared according to the method described in Example 3.

The sand-catalyst mix for each test is prepared by mulling 3000 parts Wedron 5025 sand and 40 percent (based on the weight of the binder) of toluene sulfonic acid (65 percent solution in water). The mulling continues until a uniform distribution of the acid on the admixture is achieved.

The binder is employed in the mix in a level of 36 parts, 45 parts, and 54 parts in Tests 8-1, 8-2, and 8-3, respectively.

The tensile strength specimen biscuits were prepared and tested by the method described in Example 2. The results are listed in Table VII.

TABLE VII

| Test | % Binder Based on Sand | Bench life (Min.) | Tensile Strength (psi)/Scratch Hardness 30% R.H. | 95% R.H. |
|---|---|---|---|---|
| 8-1 | 1.2 | 36 | 330/84 | 150/79 |
| 8-2 | 1.5 | 30 | 345/86 | 155/78 |
| 8-3 | 1.8 | 28 | 380/88 | 170/82 |

EXAMPLE 9

The purpose of this example is to illustrate the effect of employing various silanes in the binders of the present invention. The silanes employed are A1160 Ureido-silane (50 percent methanol, T.M. Union Carbide Chemicals & Plastics) a gamma-ureidopropyltriethoxy silane, and A1100 gamma-aminopropyltriethoxysilane (T.M. Union Carbide Chemicals & Plastics).

The binder in each respective test is prepared by admixing, separately, according to the method of Example 1, 65 parts of furfuryl alcohol, 7 parts of ethylene glycol, 7 parts of Areotex 581 urea-formaldehyde syrup, 21 parts of the Terates listed in Table VIII, and 0.3 parts of the silane additive.

In Tests 9-1 through 9-3, A1100 gamma-aminopropyltriethoxy silane is added to the binder and stirred for 10 minutes to completely distribute the silane in the binder. In Tests 9-4 through 9-6 A1160 Ureido-silane is added to the binder and stirred for 10 minutes. In Tests 9-1 and 9-4, the Terate additive is Terate 131. In Tests 9-2 and 9-5, the Terate employed is Terate 203, and in Tests 9-3 and 9-6, the Terate is Terate 303.

The catalyst-sand mixes are prepared by the method described in Example 6.

Then, a 37.5 part aliquot of each respective binder is added to each respective sand-catalyst mix and the respective admixtures are mulled separately. As soon as the binder is uniformly distributed on the acid-catalyzed sand mix, the respective catalyzed binder coated mixes are subjected to bench life determination and, after curing, to tensile strength tests by the method described in Example 2.

The tensile strength numbers set forth in Table VIII represent an average of six determinations, in each instance.

TABLE VIII

| Test | *Silane (0.3 parts) | Terate** | Bench Life (Min.) | Tensile Strength (psi)/Scratch Hardness 30% R.H. | 95% R.H. |
|---|---|---|---|---|---|
| 9-1 | A-1100 | 131 | 60 | 175/50 | 80/37 |
| 9-2 | A-1100 | 203 | 87 | 370/61 | 140/53 |
| 9-3 | A-1100 | 303 | 50 | 240/51 | 120/39 |
| 9-4 | A-1160 | 131 | 55 | 425/62 | 275/63 |
| 9-5 | A-1160 | 203 | 80 | 420/65 | 180/64 |
| 9-6 | A-1160 | 303 | 65 | 400/63 | 285/57 |

*A-1100 - gamma-Aminopropyltriethoxysilane (T.M. Union Carbide Chemicals & Plastics).
*A-1160 - Uredio-silane (50 percent in methanol, T.M. Union Carbide Chemicals & Plastics).
**Terate 131 (T.M. Hercules, Incorporated) comprises: 10 parts carbomethoxyl diphenyl, 4 parts benzyl esters of toluate family, and 45 parts carbomethoxy polyphenyls. Terate 203 (T.M. Hercules, Incorporated) is the transesterification product of diethylene glycol and Terate 101 (T.M. Hercules, Incorporated). Terate 101 comprises: 30 parts polycarbomethoxyl diphenyl, 25 parts benzyl esters of the toluate family and 35 parts carbomethoxy polyphenyls. Terate 303 (T.M. Hercules, Incorporated) is the transesterification product of ethylene glycol and Terate 131 (T.M. Hercules, Incorporated).

EXAMPLE 10

The purpose of this example is to illustrate the effect of employing a relatively large amount of furfuryl alcohol in a binder of the present invention.

The binder is prepared by admixing, according to the method described in Example 1, 80 parts of furfuryl alcohol, 5 parts of ethylene glycol, 5 parts Areotex 581 urea-formaldehyde (T.M. American Cyanamid) and 10 parts Terate 203 (T.M. Hercules, Incorporated). Terate 203 is a transesterification product of diethylene glycol and Terate 101 (T.M. Hercules, Incorporated). Terate 101 comprises: 30 parts polycarbomethoxyl diphenyls, 25 parts benzyl esters of the toluate family, and 35 parts carbomethoxy polyphenyls. To this admixture is added 0.3 parts of A-1160 Ureido-silane (T.M. Union Carbide Chemicals & Plastics).

The sand-catalyst mix is prepared by the method described in Example 2.

In the sand-binder mixture, the binder is present on the sand in an amount of 1.25 parts based on the weight of the sand. The sand-binder mix has a bench life of 50 minutes. At ambient relative humidity, the six tensile strength specimen biscuits tested according to the method set forth in Example 2, have an average tensile strength of 355, while at 95 percent relative humidity the average tensile strength is 350 psi.

We claim:

1. A foundry binder comprising monomeric furfuryl alcohol in an amount between 45–85 percent, inclusive, an aromatic resin mixture of carbomethoxy polyphenyl and polycarbomethoxy diphenyls, said aromatic mixture being present in an amount between 5–50 percent, inclusive, another alcohol in an amount between 2–15 percent, inclusive, all percentages being percent by weight based on the weight of the binder.

2. The binder of claim 1 in which the furfuryl alcohol is present in an amount of about 65 percent.

3. The binder of claim 1 which also includes a urea-formaldehyde ingredient in an amount from 0–30 percent by weight based on the weight of the binder.

4. The binder of claim 1 in which the binder includes benzyl esters of the toluate family.

5. The binder of claim 1 in which the other alcohol is a member selected from the group ethylene glycol, diethylene glycol, isooctyl alcohol, isobutyl alcohol, tetrahydrofurfuryl alcohol, propylene glycol, glycerol, isopropyl alcohol, 1-propaneol, butanediol, and pinacol.

6. The method of making foundry sand shapes comprising the steps:

a. admixing foundry sand and a strong acid catalyst having a pKa less than 2.3 to produce a sand-catalyst mixture;

b. admixing with the resulting sand-catalyst mixture with a binder comprising monomeric furfuryl alcohol in an amount between 45–85 percent, inclusive, an aromatic resin mixture of carbomethoxy polyphenyl and polycarbomethoxy diphenyls, said aromatic mixture being present in an amount between 5–50 percent, inclusive, another alcohol in an amount between 2–15 percent, inclusive, all percents being by weight based on the weight of the binder;

said binder being used in an amount of 0.5 to 3 percent based on the weight of the sand, said acid catalyst being used in and amount between 10–75 percent based on the weight of the binder.

7. The method of claim 6 in which the binder is used in an amount from 1 to 1½ percent, inclusive, and the catalyst is used in an amount from 2–60 percent by weight, inclusive, based on the weight of the binder.

8. The method of claim 6 in which the binder includes furfuryl alcohol in an amount of about 65 percent.

9. The method of claim 6 which also includes a urea-formaldehyde ingredient in an amount from 0–30 percent by weight based on the weight of the binder.

10. The method of claim 6 which includes benzyl esters of the toluate family.

11. The method of claim 6 which includes the other alcohol which is a member selected from the group ethylene glycol, diethylene glycol, isooctyl alcohol, isobutyl alcohol, tetrahydrofurfuryl alcohol, propylene glycol, glycerol, isopropyl alcohol, 1-propaneol, butanediol, and pinacol.

* * * * *